US010987549B2

(12) United States Patent
Bava

(10) Patent No.: US 10,987,549 B2
(45) Date of Patent: Apr. 27, 2021

(54) GOLF BALL RETRIEVAL APPARATUS

(71) Applicant: Robert Bava, Randolph, NJ (US)

(72) Inventor: Robert Bava, Randolph, NJ (US)

( * ) Notice: Subject to any disclaimer, the term of this patent is extended or adjusted under 35 U.S.C. 154(b) by 0 days.

(21) Appl. No.: 15/643,450

(22) Filed: Jul. 6, 2017

(65) Prior Publication Data

US 2018/0126227 A1 May 10, 2018

Related U.S. Application Data

(60) Provisional application No. 62/359,074, filed on Jul. 6, 2016.

(51) Int. Cl.
*A63B 47/02* (2006.01)
*A63B 57/00* (2015.01)

(52) U.S. Cl.
CPC ..... *A63B 47/02* (2013.01); *A63B 57/00* (2013.01); *A63B 2210/50* (2013.01); *A63B 2225/05* (2013.01)

(58) Field of Classification Search
CPC ..... A63B 47/02; A63B 57/00
USPC ..... 294/19.2
See application file for complete search history.

(56) References Cited

U.S. PATENT DOCUMENTS 2,760,807 A 8/1956 Watson
4,021,068 A 5/1977 Piazza
5,040,675 A * 8/1991 Cleveland ..... A63B 47/00 206/315.9
5,395,146 A * 3/1995 Liu ..... A63B 47/002 221/199
5,437,488 A * 8/1995 Richmond ..... A63B 47/02 294/19.2
5,472,251 A * 12/1995 Deininger ..... A63B 47/02 294/19.2
5,672,121 A * 9/1997 Miller ..... A63B 47/02 294/19.2
6,743,113 B2 * 6/2004 Pettinga ..... A63B 47/02 294/19.2
7,086,971 B2 * 8/2006 Zmetra ..... A63B 47/02 294/19.2
D550,315 S * 9/2007 Siverly ..... D21/721
8,657,351 B2 * 2/2014 Johnson ..... A63F 9/0001 135/74
2005/0181886 A1 * 8/2005 Zmetra ..... A63B 47/02 473/286

(Continued)

*Primary Examiner* — Paul T Chin
(74) *Attorney, Agent, or Firm* — Gerry J. Elman; Elman Technology Law, P.C.

(57) ABSTRACT

A golf ball retrieval apparatus for retrieving a golf ball from a cupped hole is provided. The golf ball retrieval apparatus comprises an outer tube and an inner shaft slidably receivable within the outer tube. A retrieval mechanism is mounted to the inner shaft and capable of releasably grasping the golf ball. A cam system is mounted to the inner shaft for substantially centering the inner shaft within the outer tube and impeding the movement of the inner shaft within the outer tube. Interaction of the cam system and the outer tube impedes movement of the inner shaft within the outer tube and releasably, frictionally secures a desired position of the inner shaft relative to the outer tube. Golfers are enabled to facilitate expedient retrieval of a golf ball from a cupped hole or other location while remaining in a substantially upright position.

18 Claims, 6 Drawing Sheets

(56) References Cited

U.S. PATENT DOCUMENTS

| | | | | |
|---|---|---|---|---|
| 2006/0055189 | A1* | 3/2006 | Dalsing | A63B 57/00 294/19.2 |
| 2010/0269648 | A1* | 10/2010 | Fenstemaker | B25F 1/02 81/491 |
| 2012/0208652 | A1 | 8/2012 | Kaluza | |
| 2016/0091130 | A1* | 3/2016 | Thompson | F16L 27/12 285/123.3 |

* cited by examiner

GOLF BALL RETRIEVAL APPARATUS

CLAIM OF PRIORITY

This patent application claims priority under 35 USC 119(e)(1) from U.S. Provisional Patent Application Ser. No. 62/359,074 filed Jul. 6, 2016, of common inventorship herewith entitled, "Plunger," which is incorporated herein by reference as though the same were set forth in its entirety.

FIELD OF THE INVENTION

The present invention pertains to the field of golfing accessories, and more specifically to the field of golf ball retrieval apparatuses facilitating expedient retrieval of a golf ball from a cupped hole while remaining in an upright position.

BACKGROUND OF THE INVENTION

A popular recreational and competitive sport, the game of golf possesses a rich history. Roman emperors played a relaxing game called paganica, using a bent stick to drive a feather stuffed ball. Over the next five centuries the game developed on several continents, eventually evolving into a popular Scottish gamer known as golfe which is the direct ancestral game of golf played today. A relaxing outdoor sport of strategy and skill, golf has become a favored pastime of men, women and children.

The golf ball is a primary piece of golf equipment that comes with a specific drawback. It is taxing to constantly bend down to retrieve a played ball from the depths of a cup especially for those golfers who are elderly, obese, arthritic, or have simple back, knee and other joint pain. As a result, golfers can experience soreness and extreme discomfort shortly after beginning play, which can adversely affect their game.

The prior art has put forth several designs for golf ball retrieval devices. Among these are:

US Patent Publication 2012/0208652 to Bernhard Kaluza and Ralph Rhein describes a golf ball grabbing device including a cap affixable at the longitudinal extremity of the grip of a putter shaft and having a single central opening with finger receiving guide notches therearound. A movable grabber assembly has a base member movably retained within the shaft below the cap and at least three nondestructible resiliently deformable strip fingers. Each finger has a proximal end secured to the base member, an arcuate ball grabbing portion, and a distal end terminating in a camming member with a planar, ball engageable face. Each finger is slidably engaged within one of the notches. The movable grabber assembly is slidable with respect to the cap between a nonuse position and a use position.

U.S. Pat. No. 4,021,068 to Anthony F. Piazza describes a device for retrieving golf balls comprising a tapered receptacle and a vacuum pump whereby a golf ball is forced into and retained in the receptacle by direct pressure or by use of a vacuum producing means. The vacuum producing means functions as a pressurizing system for freeing a retained golf ball at the convenience of a user. The vacuum producing means is comprised of a tubular handle and a close fitting piston joined to an elongated and slidable rod which is terminated in its upper section in a knob for grasping. A lower rod section extends from the piston where entry of a golf ball into the receptacle is induced by lowering the receptacle over the ball. The lower rod section also functions in releasing the golf ball when said knob is pushed downwards with respect to the tubular handle.

U.S. Pat. No. 2,760,807 to William G Watson describes a golf ball retrieval device comprising a unique construction and arrangement of parts whereby a multiplicity of golf balls are expeditiously picked up and stored without a necessity of bending over or stooping. The ball retrieving component comprises a cylindrical tube open at one end for the reception of a ball and has circumferentially spaced apertures therein. A resilient ring mounted on the tube has anchoring lugs engaged in the apertures. The ring includes an internal shoulder at an intermediate point abutting the open end of the tube, and further includes an integral funnel on one end projecting beyond the open end of the tube and aligned therewith for directing the ball thereinto. The funnel includes a tapered inner end portion projecting into the tube from the shoulder and has spaced slots providing a plurality of arcuate resilient lips. The spaced slots define drain passages for the tube, and the lips are yieldable for ball passage and engageable therebeneath for ball retention.

None of these prior art references describe the present invention.

SUMMARY OF THE INVENTION

It is an object of the present invention to provide an assistive ball retrieval device particularly configured to enable golfers to facilitate expedient retrieval of a golf ball from a cupped hole while remaining in an upright position.

The present invention is a golf ball retrieval apparatus for retrieving a golf ball from a cupped hole or other location. The golf ball retrieval apparatus comprises an outer tube having an outer surface, an inner surface, a first end, and a second end opposite the first end. An inner shaft is slidably receivable within the outer tube with the inner shaft having an outer surface, a first end, and a second end opposite the first end. A retrieval mechanism is mounted to the first end of the inner shaft, the retrieval mechanism capable of releasably grasping the golf ball. A cam system is mounted to the second end of the inner shaft for substantially centering the inner shaft within the outer tube and impeding the movement of the inner shaft within the outer tube. The inner shaft is slidably movable within the outer tube to move the retrieval mechanism in a general direction away from and toward the first end of the outer tube. Interaction of the cam system and the inner surface of the outer tube impedes movement of the inner shaft within the outer tube and releasably, frictionally secures a desired position of the inner shaft relative to the outer tube. Golfers are enabled to facilitate expedient retrieval of a golf ball from a cupped hole or other location while remaining in a substantially upright position.

In addition, the present invention includes a method for retrieving a golf ball from a cupped hole or other location. The method comprises providing an outer tube having an outer surface, an inner surface, a first end, and a second end opposite the first end, providing an inner shaft having an outer surface, a first end, and a second end opposite the first end, mounting a retrieval mechanism to the first end of the inner shaft, slidably inserting the second end of the inner shaft within the first end of the outer tube, radially centering the inner shaft within the outer tube, impeding movement of the inner shaft within the outer tube, sliding the inner shaft within the outer tube, moving the retrieval mechanism in a general direction away from and toward the first end of the outer tube, releasably, frictionally securing the retrieval mechanism in a desired position of the inner shaft relative to the outer tube, and enabling golfers to facilitate expedient retrieval of a golf ball from a cupped hole or other location while remaining in a substantially upright position.

The present invention further includes a golf ball retrieval apparatus for retrieving a golf ball from a cupped hole or other location. The golf ball retrieval apparatus comprises an outer tube having an outer surface, an inner surface, a first end, and a second end opposite the first end. An inner shaft is slidably receivable within the outer tube with the inner shaft having an outer surface, a first end, and a second end opposite the first end. A suction cup is provided having a cup portion and a tubular securing portion with the cup portion of the suction cup being capable of releasably grasping the golf ball and the securing portion of the suction cup being sized and shaped for receiving the first end of the inner shaft. A cam system is mounted to the second end of the inner shaft with the cam system having a cam shaft having an outer surface, a first end, and a second end opposite the first end, a first cam member mounted to the first end of the cam shaft, a second cam member mounted to the cam shaft at a position between the first cam member and the second end of the cam shaft, and a resilient cam gasket mounted between the first cam member and the second cam member. The cam gasket has a diameter greater than an inner diameter of the outer tube. The inner shaft is slidably movable within the outer tube to move the retrieval mechanism in a general direction away from and toward the first end of the outer tube. Interaction of the cam system and the inner surface of the outer tube substantially centers the inner shaft within the outer tube and impedes rotational and axial movement of the inner shaft within the outer tube. Golfers are enabled to facilitate expedient retrieval of a golf ball from a cupped hole or other location while remaining in a substantially upright position.

DETAILED DESCRIPTION OF THE INVENTION

Figure 1:
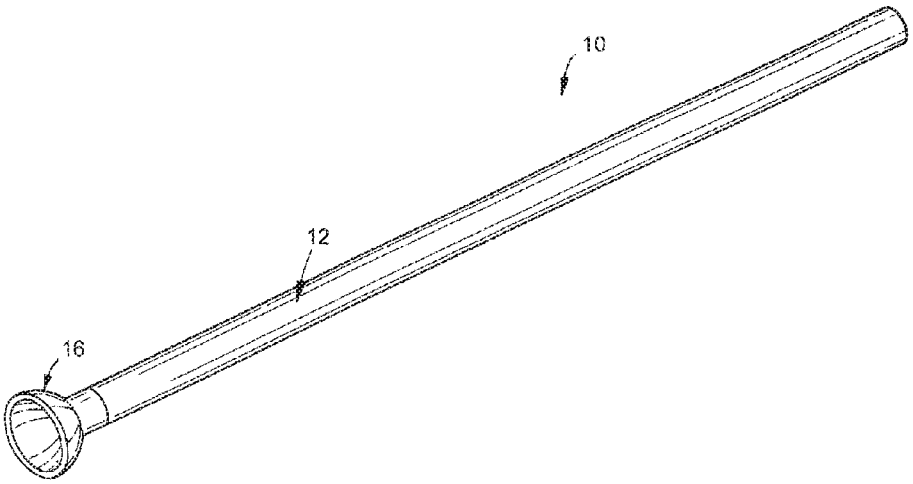
FIG. 1 is a perspective view illustrating a golf ball retrieval apparatus 10, constructed in accordance with the present invention.
Figure 2:
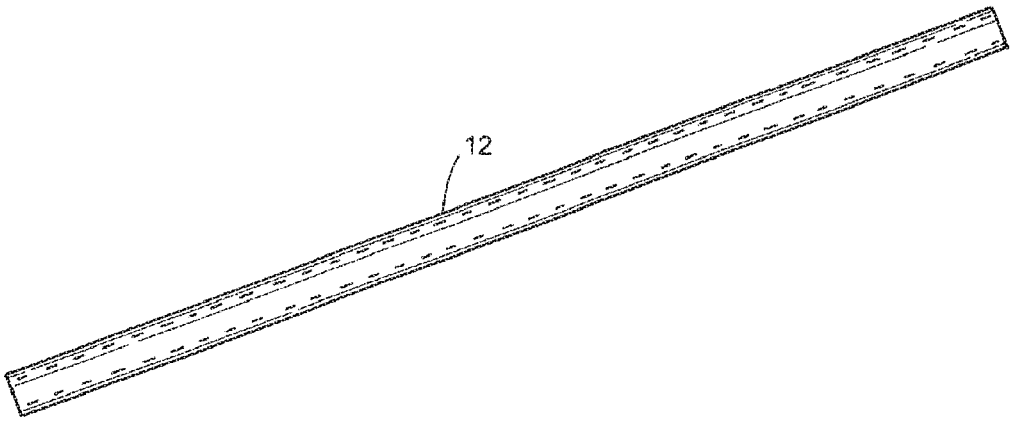
FIG. 2 is a perspective view illustrating an outer tube 12 of the golf ball retrieval apparatus, constructed in accordance with the present invention.
Figure 3:
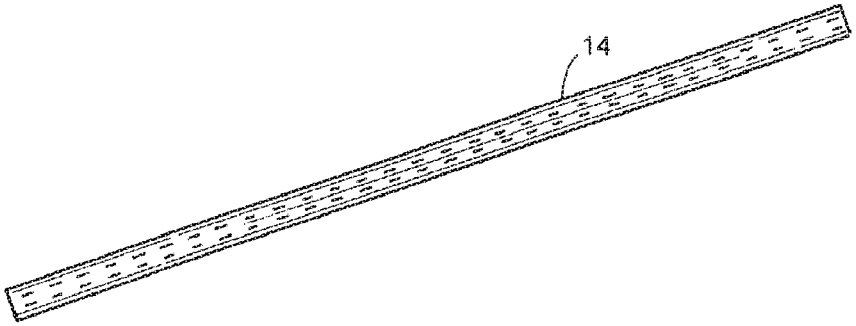
FIG. 3 is a perspective view illustrating an inner shaft 14 of the golf ball retrieval apparatus, constructed in accordance with the present invention.
Figure 4:
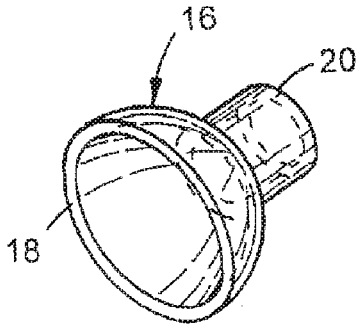
FIG. 4 is a perspective view illustrating a suction cup device 16 of the golf ball retrieval apparatus, constructed in accordance with the present invention, with the suction cup 18 functioning to retrieve and releasably hold a golf ball.
Figure 5:
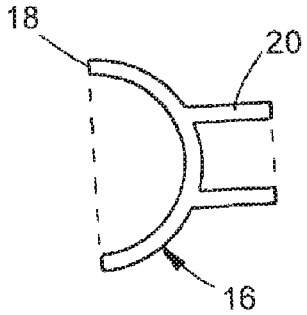
FIG. 5 is a top plan view illustrating the suction cup device 16 of the golf ball retrieval apparatus, constructed in accordance with the present invention.
Figure 6:
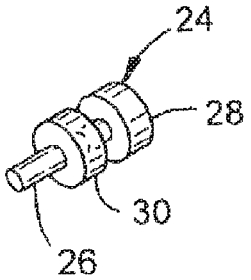
FIG. 6 is a perspective view illustrating a cam system 24 of the golf ball retrieval apparatus, constructed in accordance with the present invention, with a cam shaft 26, a pair of cam members (28 and 30) mounted about the cam shaft.
Figure 7:
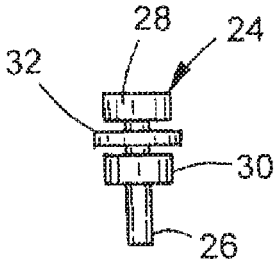
FIG. 7 is an elevational side view illustrating the cam system 24 of the golf ball retrieval apparatus, constructed in accordance with the present invention, with a cam shaft 26, a pair of cam members (28 and 30) mounted about the cam shaft, and a cam gasket 32 mounted between the cam members.
Figure 8:
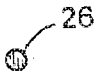
FIG. 8 is a bottom plan view illustrating the cam shaft 26 of the cam system of the golf ball retrieval apparatus, constructed in accordance with the present invention.
Figure 9:
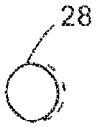
FIG. 9 is top plan view illustrating one of the cam members 28 of the cam system of the golf ball retrieval apparatus, constructed in accordance with the present invention.
Figure 10:
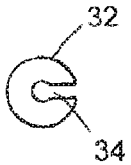
FIG. 10 is a top plan view illustrating the cam gasket 32 and key hole slot 34 of the cam system of the golf ball retrieval apparatus, constructed in accordance with the present invention.
Figure 11:
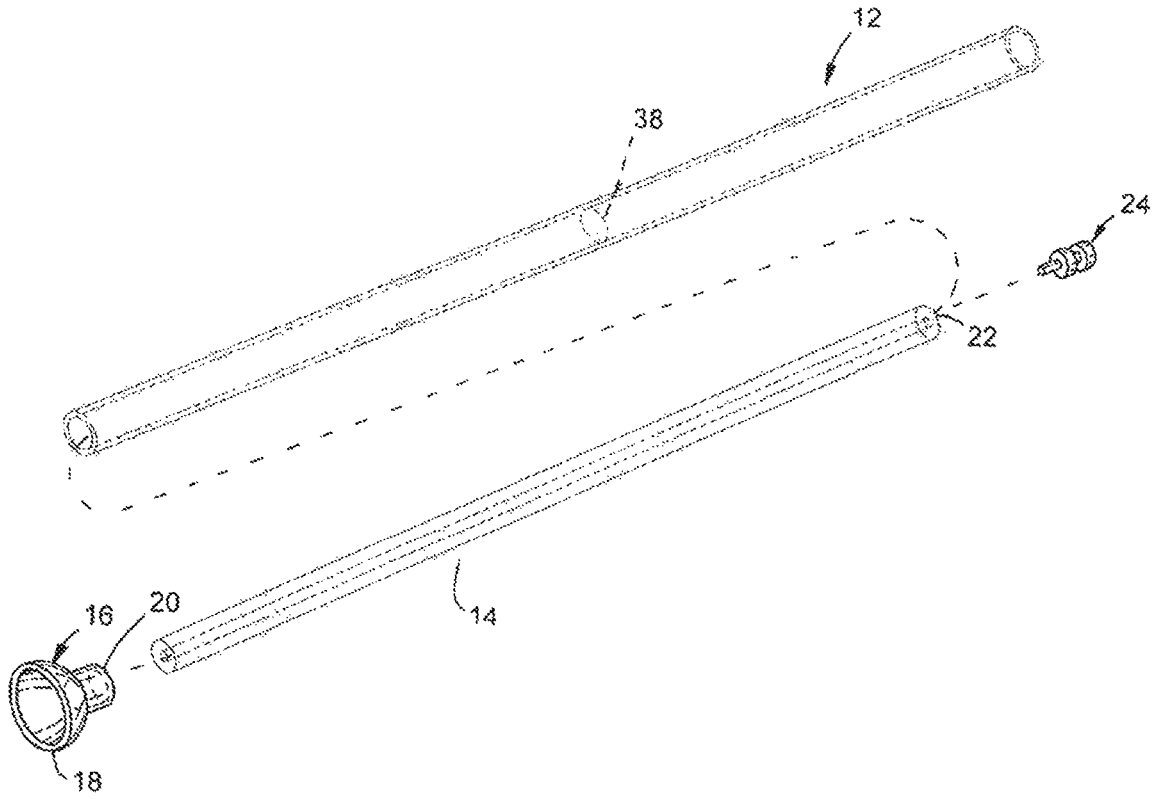
FIG. 11 is an exploded sectional perspective view illustrating the golf ball retrieval apparatus, constructed in accordance with the present invention, having annular stop mechanism 38 within outer tube 12, and with the cam system 24 mountable to one end of the inner shaft 14, the suction cup 16 mountable to the other end of the inner shaft 14, and the inner shaft slidably receivable within the outer tube 12.
Figure 12:
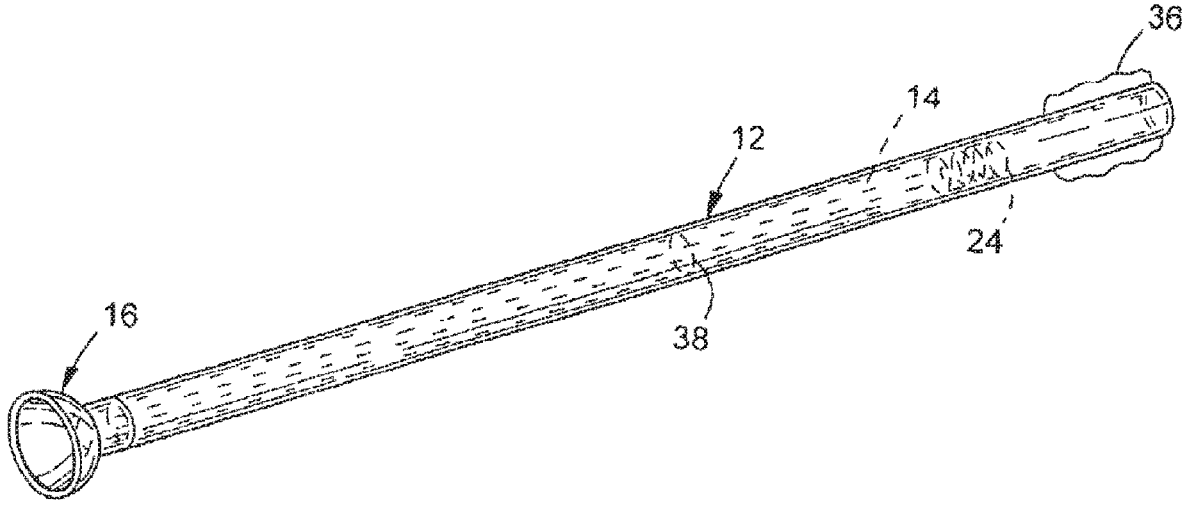
FIG. 12 is a sectional perspective view illustrating the golf ball retrieval apparatus, constructed in accordance with the present invention, with the cam system 24 mountable to one end of the inner shaft 14, the suction cup 16 mountable to the other end of the inner shaft 14, and the inner shaft inserted through annular stop mechanism 38 and slidably receivable within the outer tube 12.
Figure 13:
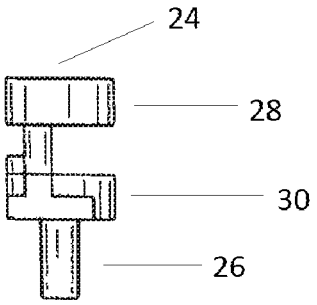
FIG. 13 is a side perspective view of the plunger twist and lock cam system 24.
Figure 14A:
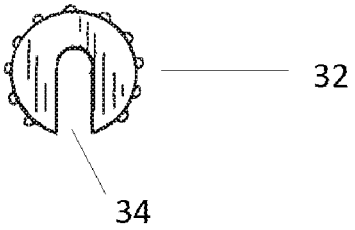
FIG. 14*a* is a top down perspective view of the cam gasket 32 for the twist and lock cam system.
Figure 14B:
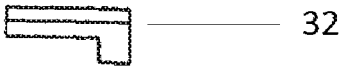
FIG. 14*b* is a side view of the left end of the cam gasket 32 shown in FIG. 14*a*.
Figure 14C:
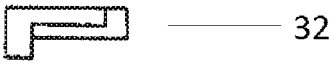
FIG. 14*c*. is a side view of the right end of the cam gasket 32 shown in FIG. 14*a*.
Figure 15A:
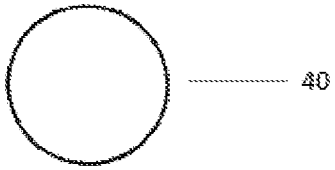
FIG. 15*a* is a top down view of the opening on the top of the plunger outer tube cap 40.
Figure 15B:
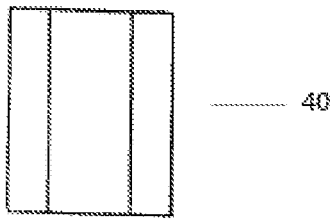
FIG. 15*b* is a side view of the exterior of the plunger outer tube cap 40 showing ridges.
Figure 15C:
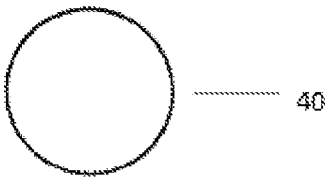
FIG. 15*c* is a top down view showing the opening on the bottom of the plunger outer tube cap 40.
Figure 15D:
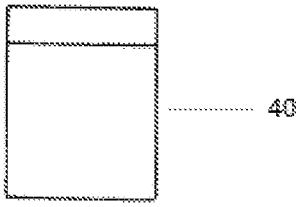
FIG. 15*d* is a side view of the plunger outer tube cap 40 showing ridges on the interior of the cap.
Figure 16:
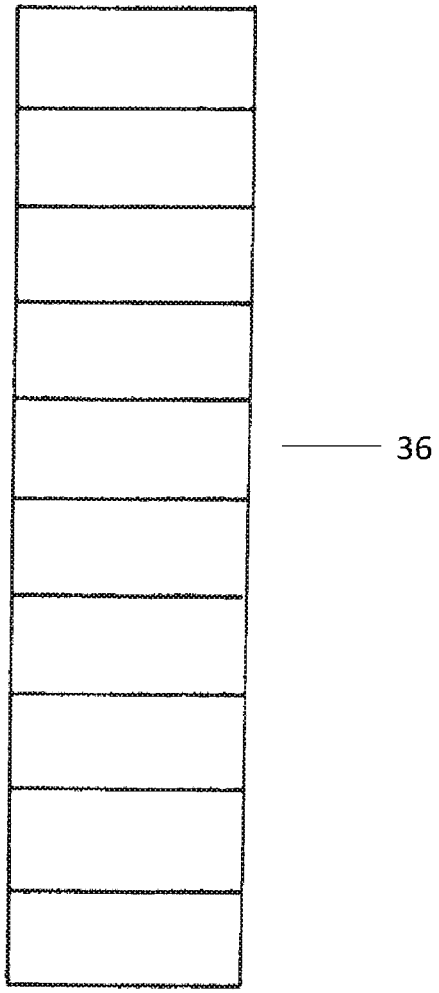
FIG. 16 is a side view of the plunger grip 36.
Figure 17:
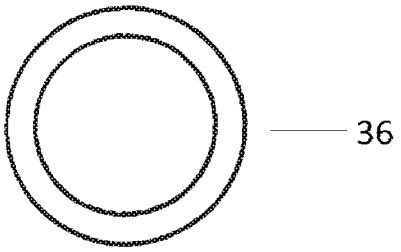
FIG. 17 is a top down view of the plunger grip 36.

The present invention, hereinafter referred to as a Golf Ball Retrieval Apparatus, indicated generally at 10, providing an assistive ball retrieval device particularly configured to enable golfers to facilitate expedient retrieval of a golf ball from a cupped hole while remaining in an upright position. Easily adjustable in length, the Golf Ball Retrieval Apparatus 10 provides golfers, particularly those with limited physical capabilities, with a more user friendly means of picking up a golf ball. Using the Golf Ball Retrieval Apparatus 10 enables a golfer to retrieve a golf ball without bending over and without marring any part of the golf cup or greens.

The Golf Ball Retrieval Apparatus 10 of the present invention includes an outer tube 12 having an outer surface, an inner surface, a first end, and a second end opposite the first end. Preferably, the outer tube 12 has a length of approximately one (1') foot and ten (10") inches, an outer diameter of approximately seven-eighths (⅞") inch, and an inner diameter of approximately twenty-one thirty-seconds (21/32") inch although constructing the outer tube 12 with other dimensions is within the scope of the present invention. In addition, the outer tube 12 is preferably constructed from a durable plastic or metal material although constructing the outer tube 12 from other rigid materials is within the scope of the present invention.

In addition, the Golf Ball Retrieval Apparatus 10 of the present invention includes an inner shaft 14 slidably receivable within the outer tube 12. The inner shaft 14 has an outer surface, a first end, and a second end opposite the first end. Preferably, the inner shaft 14 has a length of approximately one (1') foot and six (6") inches and an outer diameter of approximately five-eighths (⅝") inch although constructing the inner shaft 14 with other dimensions is within the scope of the present invention. In addition, the inner shaft 14 is preferably constructed from a durable plastic or metal material although constructing the inner shaft 14 from other rigid materials is within the scope of the present invention.

Furthermore, the Golf Ball Retrieval Apparatus 10 of the present invention includes a suction cup 16 or other retrieval mechanism mounted to the first end of the inner shaft 14. The suction cup 16 includes a cup portion 18 and a tubular securing portion 20 mounted to the cup portion 18. The securing portion 20 is sized and shaped for receiving the first end of the inner shaft 14. Preferably, the securing portion 20 is releasably held to the first end of the inner shaft 14 by friction or other mechanical securing means, such as adhesive, screws, pins bolts, welds, etc.

In an embodiment of the Golf Ball Retrieval Apparatus 10 of the present invention, the inner shaft 14 includes a receiving aperture 22 formed in the second end of the inner shaft 14. Preferably, the receiving aperture 22 has a diameter of approximately three-sixteenths (3/16) inch although having constructing the receiving aperture 22 with a different dimension is within the scope of the present invention. In another embodiment, the receiving aperture 22 formed in the second end of the inner shaft 14 extends completely through the inner shaft 14 from the second end of the inner shaft 14 to the first end of the inner shaft 14. Forming the receiving aperture 22 completely through the inner shaft 14 reduces the weight of the inner shaft 14, and thus the entire Golf Ball Retrieval Apparatus 10, thereby increasing the functionality of the Golf Ball Retrieval Apparatus 10.

The Golf Ball Retrieval Apparatus 10 of the present invention additionally includes a cam system 24 for substantially centering the inner shaft 14 within the outer tube 12 and impeding the movement of the inner shaft 14 within the outer tube 12. The cam system 24 preferably includes a cam shaft 26 having an outer surface, a first end, and a second end opposite the first end. A first cam member 28 is mounted to the cam shaft 26 at the first end of the cam shaft 26 and a second cam member 30 is mounted to the cam shaft 26 at a desired position between the first cam member 28 and the second end of the cam shaft 26. To allow the inner shaft 14 to axially move within the outer tube, the diameter of each of the first cam member 28 and the second cam member 30 is at least slightly less than the inner diameter of the outer tube 12. Actual operation of the Golf Ball Retrieval Apparatus 10 will be described in further detail below.

In a preferred embodiment of the Golf Ball Retrieval Apparatus 10 of the present invention, the first cam member 28 and the second cam member 30 have a diameter of approximately nine-sixteenths (9/16") inch. In order to better operate the axial slidability of the inner shaft 14 within the outer tube 14, one side of the first cam member 28 and/or the second cam member 30 can be removed, i.e., shaved. Preferably, the shaved portion is one-sixteenth (1/16") inch on an outside surface of the first cam member 28 and/or the second cam member 30.

Preferably, the first cam member 28 and the second cam member 30 of the cam system 24 of the Golf Ball Retrieval Apparatus 10 of the present invention are spaced from each other for receiving a cam gasket 32 therebetween, as described further below. In addition, preferably, the second cam member 30 is mounted in the approximate center of the cam shaft 26 between the first end and the second end of the cam shaft 26 allowing an extended portion of the cam shaft 26 to be received within the receiving aperture 22 of the inner shaft 14. Preferably, the cam shaft 26 is releasably held within the receiving aperture 22 of the inner shaft 14 by friction or other mechanical securing means, such as adhesive, screws, pins, bolts, welds, etc. Preferably, the cam shaft 26, the first cam member 28, and the second cam member 30 are constructed from a durable plastic material although constructing the cam shaft 26, the first cam member 28, and/or the second cam member 30 can be constructed from a different material.

As stated above, the cam system 24 of the Golf Ball Retrieval Apparatus 10 of the present invention includes the cam gasket 32 releasably mounted between the first cam member 28 and the second cam member 30 of the cam system 24. Preferably, the cam gasket 32 is constructed from a resilient, durable material allowing the cam gasket 32 to deform within outer tube 12. The cam gasket 32 has a diameter slightly larger (i.e., eleven-sixteenths (11/16") inch, for example) and can be deformed prior to insertion into the outer tube 12, as will be described in further detail below.

The cam gasket 32 of the cam system 24 of the Golf Ball Retrieval Apparatus 10 of the present invention includes a keyhole slot 34 formed from an outer edge to a center of the cam gasket 32 allowing the cam gasket 32 to be positioned on the outer surface of the cam shaft 26 and held thereon by the keyhole slot 34. The cam gasket 32 impedes (not prohibits) lateral and axial movement of the inner shaft 14 relative to the outer tube 12.

Further yet, in an embodiment of the Golf Ball Retrieval Apparatus 10 of the present invention, the second end of the outer tube 12 can be sheathed in a comfortable ergonomic vinyl or rubber plunger grip 36 having a plunger outer tube cap 40 for easy gripping in a golfer's hand. The plunger grip 36 allows the user to easily grasp the Golf Ball Retrieval Apparatus 10 during the retrieval of the golf ball.

To assemble the Golf Ball Retrieval Apparatus 10 of the present invention, the cam gasket 32 is positioned on the cam shaft 26 between the first cam member 28 and the second cam member 30. An adhesive substance is applied to the second end of the cam shaft 26 and the second end of the cam shaft 26 is inserted into the receiving aperture 22 formed in the second end of the inner shaft 14. Upon drying of the adhesive substance, the first end of the inner shaft 14 is inserted into the tubular opening at the second end of the outer tube 12. As first end of the inner shaft 14 slides toward the first end of the outer tube 12, the cam gasket 32 is slightly deformed thereby allowing the cam system 24 to be inserted into the second end of the outer tube 12. The inner shaft 14 continually slides through the outer tube 12 until the first end of the inner shaft 14 exits the first end of the outer tube 12. Next, an adhesive substance is applied to the first end of the inner shaft 14 and the tubular securing portion 20 of the suction cup 16 is mounted over the first end of the inner shaft 14. Finally, the plunger grip 36 and plunger outer tube cap 40 are secured around the second end of the outer tube 12.

The extent of travel of the inner shaft 14 of the Golf Ball Retrieval Apparatus 10 of the present invention relative to the outer tube 12 is provided. The suction cup 16 limits the extent of travel of the inner shaft 14 in a general direction toward the second end of the outer tube 12. To limit the extent of travel of the inner shaft 14 in a general direction toward the first end of the outer tube 12, an annular stop mechanism 38 is mounted within the outer tube 12. The annular stop 38 allows the inner shaft 14 to move through the annular stop 38 but interacts with the cam system 24 to inhibit further movement of the inner shaft 14 toward the first end of the outer tube 12.

Using the Golf Ball Retrieval Apparatus 10 of the present invention is very simple and straightforward. Gripping handle 36 on the outer tube 12, the golfer lowers the suction cup 16 at the first end of the inner shaft 14 into the cup hole and presses down. The suction power of the suction cup 16 grips the golf ball securely. The golfer lifts the Golf Ball Retrieval Apparatus 10 and golf ball out of the cupped hole and release it into their hand while remaining in an upright stance the entire time.

The inner shaft 14 of the Golf Ball Retrieval Apparatus 10 of the present invention telescopes from the outer tube 12 with the cam gasket 32 releasably securing the extent of the inner shaft 14 relative to the outer shaft 12. Other means for releasably securing the extent of the inner shaft 14 relative to the outer shaft 12 include a compressible pin that functions to lock the present invention securely into place once a desired length is obtained. An alternative mechanism to lock the inner shaft 14 relative to the outer tube 12 in place is to twist the inner shaft 14 relative to the outer tube 12 counter clockwise to unlock, and then twist clockwise to relock.

Using the Golf Ball Retrieval Apparatus 10 of the present invention alleviates common problems encountered when manually picking up a golf ball, especially from a golf cup in the ground which is approximately four (4") inches below ground level. Common problems of muscle strain and taxing one's back and knees no longer are an issue. Golfers can enjoy relaxing and pain free play and ball retrieval. Compact in size, easily transported and handled, and durably constructed of high quality materials, the Golf Ball Retrieval Apparatus 10 will withstand many years of continued use.

Although this invention has been described with respect to specific embodiments, it is not intended to be limited thereto and various modifications which will become apparent to the person of ordinary skill in the art are intended to fall within the spirit and scope of the invention as described herein taken in conjunction with the accompanying drawings and the appended claims.

The invention claimed is:

1. A golf ball retrieval apparatus for retrieving a golf ball from a cupped hole or other location, the golf ball retrieval apparatus comprising:

an outer tube having an outer surface, an inner surface, a first end, and a second end opposite the first end;

an inner shaft slidably receivable within the outer tube, the inner shaft having an outer surface, a first end, and a second end opposite the first end;

a retrieval mechanism mounted to the first end of the inner shaft, the retrieval mechanism capable of releasably grasping the golf ball; and a cam system mounted to the second end of the inner shaft for substantially centering the inner shaft within the outer tube and impeding the movement of the inner shaft within the outer tube;

wherein the inner shaft is slidably movable within the outer tube to move the retrieval mechanism in a general direction away from and toward the first end of the outer tube;

wherein interaction of the cam system and the inner surface of the outer tube impedes movement of the inner shaft within the outer tube and releasably, frictionally secures a desired position of the inner shaft relative to the outer tube; and wherein the cam system has a cam shaft having an outer surface, a first end, and a second end opposite the first end, a first cam member mounted to the first end of the cam shaft, and a second cam member mounted to the cam shaft at a position between the first cam member and the second end of the cam shaft;

wherein golfers are enabled to facilitate expedient retrieval of a golf ball from a cupped hole or other location while remaining in a substantially upright position.

2. The golf ball retrieval apparatus of claim 1 wherein the retrieval mechanism is a suction cup having a cup portion and a tubular securing portion, the cup portion of the suction cup being capable of releasably grasping the golf ball, the securing portion of the suction cup being sized and shaped for receiving the first end of the inner shaft.

3. The golf ball retrieval apparatus of claim 1 and further comprising:

a receiving aperture formed in the second end of the inner shaft;

wherein at least a portion of the cam system is receivable within the receiving aperture.

4. The golf ball retrieval apparatus of claim 3 wherein the receiving aperture extends completely through the inner shaft from the second end of the inner shaft to the first end of the inner shaft.

5. The golf ball retrieval apparatus of claim 1 wherein diameters of each of the first cam member and the second cam member are at least slightly less than an inner diameter of the outer tube.

6. The golf ball retrieval apparatus of claim 5 wherein a portion of one side of the first cam member or a portion of one side of the second cam member are removed.

7. The golf ball retrieval apparatus of claim 1 wherein the first cam member and the second cam member of the cam system are spaced from each other, and further comprising:

a resilient cam gasket mounted between the first cam member and the second cam member, the cam gasket having a diameter greater than an inner diameter of the outer tube.

8. The golf ball retrieval apparatus of claim 7 wherein the cam gasket has a keyhole slot formed from an outer edge to a center of the cam gasket allowing the cam gasket to be positioned on the cam shaft and held thereon by the keyhole slot.

9. The golf ball retrieval apparatus of claim 1 wherein the second cam member is mounted in an approximate center of the cam shaft between the first end and the second end of the cam shaft allowing an extended portion of the cam shaft to be received within the receiving aperture of the inner shaft.

10. The golf ball retrieval apparatus of claim 1 and further comprising:

an ergonomic handle mounted around the second end of the outer tube.

11. The golf ball retrieval apparatus of claim 1 wherein the retrieval mechanism limits the extent of travel of the inner shaft in a general direction toward the second end of the outer tube and an annular stop mechanism mounted within the outer tube limits the extent of travel of the inner shaft in a general direction toward the first end of the outer tube, the annular stop interacting with the cam system to inhibit further movement of the inner shaft toward the first end of the outer tube.

12. A golf ball retrieval apparatus for retrieving a golf ball from a cupped hole or other location, the golf ball retrieval apparatus comprising:

an outer tube having an outer surface, an inner surface, a first end, and a second end opposite the first end;

an inner shaft slidably receivable within the outer tube, the inner shaft having an outer surface, a first end, and a second end opposite the first end;

a suction cup having a cup portion and a tubular securing portion, the cup portion of the suction cup being capable of releasably grasping the golf ball, the securing portion of the suction cup being sized and shaped for receiving the first end of the inner shaft; and a cam system mounted to the second end of the inner shaft, the cam system having a cam shaft having an outer surface, a first end, and a second end opposite the first end, a first cam member mounted to the first end of the cam shaft, a second cam member mounted to the cam shaft at a position between the first cam member and the second end of the cam shaft, and a resilient cam gasket mounted between the first cam member and the second cam member, the cam gasket having a diameter greater than an inner diameter of the outer tube; wherein the inner shaft is slidably movable within the outer tube to move the retrieval mechanism in a general direction away from and toward the first end of the outer tube;

wherein interaction of the cam system and the inner surface of the outer tube substantially centers the inner shaft within the outer tube and impedes rotational and axial movement of the inner shaft within the outer tube; and wherein golfers are enabled to facilitate expedient retrieval of a golf ball from a cupped hole or other location while remaining in a substantially upright position.

13. The golf ball retrieval apparatus of claim 12 and further comprising:

a receiving aperture formed in the second end of the inner shaft;

wherein at least a portion of the second end of the cam shaft of the cam system is receivable within the receiving aperture.

14. The golf ball retrieval apparatus of claim 12 wherein the receiving aperture extends completely through the inner shaft from the second end of the inner shaft to the first end of the inner shaft.

15. The golf ball retrieval apparatus of claim 12 wherein diameters of each of the first cam member and the second cam member are at least slightly less than an inner diameter of the outer tube, and wherein a portion of one side of the first cam member or a portion of one side of the second cam member are removed.

16. The golf ball retrieval apparatus of claim 12 wherein the cam gasket has a keyhole slot formed from an outer edge to a center of the cam gasket allowing the cam gasket to be positioned on the cam shaft and held thereon by the keyhole slot.

17. The golf ball retrieval apparatus of claim 12 and further comprising:

an ergonomic handle mounted around the second end of the outer tube.

18. The golf ball retrieval apparatus of claim 12 wherein the retrieval mechanism limits the extent of travel of the inner shaft in a general direction toward the second end, of the outer tube and an annular stop mechanism mounted within the outer tube limits the extent of travel of the inner shaft in a general direction toward the first end of the outer tube, the annular stop interacting with the cam system to inhibit further movement of the inner shaft toward the first end of the outer tube.

* * * * *